US005772174A

United States Patent [19]

Hirsch et al.

[11] Patent Number: 5,772,174

[45] Date of Patent: Jun. 30, 1998

[54] ADJUSTABLE STAND FOR MOUNTING ON A WALL OR THE LIKE

[76] Inventors: Steven Hirsch, 13040 Woodbridge St., Studio City, Calif. 91604; Joseph Yedvab, 4915 Gaviota Ave., Encino, Calif. 91436

[21] Appl. No.: 562,050

[22] Filed: Nov. 22, 1995

[51] Int. Cl.[6] ..... A47B 23/04

[52] U.S. Cl. ..... 248/447.1; 248/278.1; 248/447.2

[58] Field of Search ..... 248/124.1, 125.3, 248/125.7, 276.1, 278.1, 279.1, 281.11, 289.11, 284.1, 285.1, 286.1, 291.1, 144, 145, 441.1, 447, 447.2, 453, 451, 458, 462

[56] References Cited

U.S. PATENT DOCUMENTS

| | | | |
|---|---|---|---|
| 111,858 | 2/1871 | Alex | 248/447.2 |
| 314,181 | 3/1885 | Hyde | 248/454 |
| 393,649 | 11/1888 | Kirkpatrick | 248/279.1 |
| 599,706 | 3/1898 | Heineken | 248/278.1 |
| 1,063,220 | 6/1913 | Seamon | 248/278.1 |
| 1,220,578 | 3/1917 | Wise | 248/279.1 |
| 1,373,027 | 3/1921 | Simon | 248/278.1 |
| 1,732,489 | 10/1929 | Uckotter | 248/278.1 |
| 2,019,473 | 11/1935 | Anton | 248/278.1 |
| 2,634,542 | 2/1953 | Bode | 45/60 |
| 2,638,701 | 5/1953 | Dahlgreen | 45/82 |
| 2,836,225 | 5/1958 | Swenson | 155/90 |
| 4,170,336 | 10/1979 | Malis | 248/276 |
| 4,690,285 | 9/1987 | Stone | 211/41 |
| 4,726,552 | 2/1988 | Warshawsky | 248/143 |
| 4,836,486 | 6/1989 | Vossoughi et al. | 248/281.1 |
| 4,863,133 | 9/1989 | Bonnell | 248/278 |
| 4,880,193 | 11/1989 | Warshawsky | 248/122 |
| 5,160,238 | 11/1992 | Kambara | 414/663 |
| 5,165,644 | 11/1992 | Allen | 248/285.1 |
| 5,242,142 | 9/1993 | Nakamura | 248/280.1 |

FOREIGN PATENT DOCUMENTS

| | | | |
|---|---|---|---|
| 286812 | 3/1953 | Switzerland . | |
| 210283 | 1/1923 | United Kingdom | 248/441.1 |
| 45910 | 10/1959 | United Kingdom | 248/125.7 |

*Primary Examiner*—Leslie A. Braun
*Assistant Examiner*—Gwendolyn W. Baxter
*Attorney, Agent, or Firm*—Thomas I. Rozsa; Tony D. Chen

[57] ABSTRACT

An adjustable reading stand which can be mounted on any wall of a home or the like and is utilized for retaining a book or the like so that a user's hands are unoccupied to perform other tasks. The adjustable reading stand comprises a mounting base, a vertical rod, a slidable arm base, a proximal connecting rod, two spaced apart distal connecting rods, a reading platform pivoting bracket, a reading platform and a spring-biased book spring. The slidable arm base is installed on the vertical rod and slidable on the rod to adjust a vertical height for the reading platform. One end of the proximal connecting rod is attached between one ends of the two spaced apart distal connecting rods and the other end is attached to the reading platform pivoting bracket. The other ends of the two spaced apart distal connecting rods are attached to the slidable arm base. The reading platform is installed on the reading platform pivoting bracket such that it can be rotated on a horizontal plane, tilted in a vertical plane and adjusted to any vertical height.

15 Claims, 4 Drawing Sheets

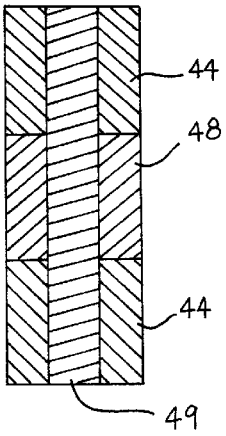
FIG.5
FIG.6
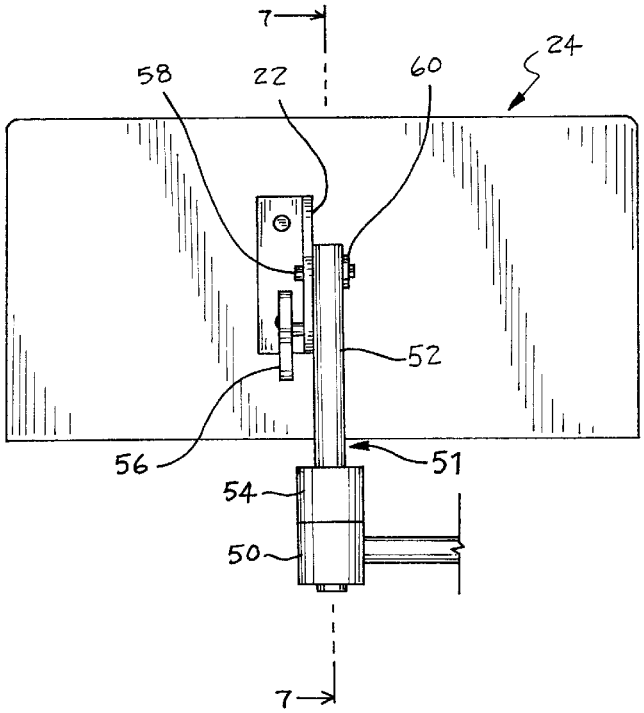
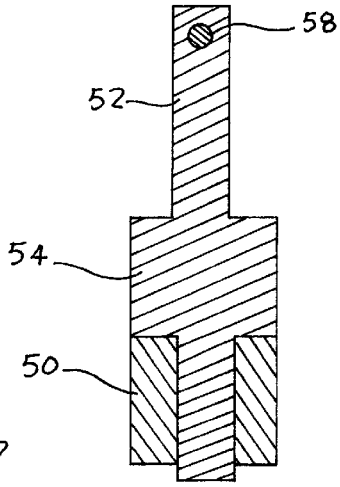
FIG.7

ADJUSTABLE STAND FOR MOUNTING ON A WALL OR THE LIKE

BACKGROUND OF THE INVENTION

1. Field of the Invention

The present invention generally relates to the field of support structures. More particularly, the present invention relates to the field of adjustable supports which can be mounted on walls or the like for retaining books, a reading materials or the like.

2. Description of the Prior Art

Generally, prior art support structures to retain reading materials have been known in the prior art for many years, as depicted below. Specifically, these support structures utilize a C-shaped clamping member which can be clamped to a chair, table or other supporting structure. The disadvantage with prior art devices is that they are not adequate to hold heavy objects.

The following twelve (12) prior art patents were uncovered in the pertinent field of the present invention:

1. U.S. Pat. No. 1,732,489 issued to Uckotter on Oct. 22, 1929 for "Awning Arm" (hereafter "the Uckotter Patent");
2. U.S. Pat. No. 2,638,701 issued to Dahigren on May 19, 1953 for "Adjustable Bookholder For Hospital Beds" (hereafter "the Dahlgren Patent");
3. U.S. Pat. No. 2,836,225 issued to Swenson on May 27, 1958 for "Seat Pedestal" (hereafter "the Swenson Patent");
4. U.S. Pat. No. 4,170,336 issued to Malis on Oct. 9, 1979 for "Suspension Apparatus For Operating Room Microscope" (hereafter "the Malis Patent");
5. U.S. Pat. No. 4,690,285 issued to Stone on September, 1987 for "Dispensing Receptacle For Drafting Equipment" (hereafter "the Stone Patent");
6. U.S. Pat. No. 4,836,486 issued to Vossoughi et al. on Jun. 6, 1989 for "Adjustable Support" (hereafter "the Vossoughi Patent");
7. U.S. Pat. No. 4,863,133 issued to Bonnell on Sep. 5, 1989 for "Arm Device For Adjustable Positioning Of A Medical Instrument Or The Like" (hereafter "the Bonnell Patent");
8. U.S. Pat. No. 4,880,193 issued to Warshawsky on Nov. 14, 1989 for "Less Than 360 Degree Lamp Swivel" (hereafter "the Warshawsky Patent");
9. U.S. Pat. No. 5,160,238 issued to Kambara on Nov. 3, 1992 for "Shaft Travel Devices Such As Vertical Lift Arm Devices" (hereafter "the Kambara Patent");
10. U.S. Pat. No. 5,242,142 issued to Nakamura on Sep. 7, 1993 for "Counterbalanced Parallel Linkage Supporting Mechanism" (hereafter "the Nakamura Patent");
11. Swiss Patent No. 286,812 (hereafter "the '812 Swiss Patent"); and
12. British Patent No. 210,283 (hereafter "the '283 British Patent").

The Uckotter Patent discloses folding awning arms. It comprises a plate which is attached to a building structure, a support, and a pivot connecting the support to the plate for swinging movement transversely of the plate.

The Dahlgren Patent discloses an adjustable bookholder for hospital beds. It comprises a frame and a book supporting plate. The frame has tubular arms inserted within each other to form the frame. The frame has one end fixed to a bed or a table by a clamping device. The book supporting plate is attached to the other end of the frame by a spindle so that the book supporting plate is rotatable around the spindle.

The Swenson Patent discloses a seat pedestal. The Swenson Patent teaches a seat supporting pedestal having means for varying the effective height of the pedestal and for varying the angular relation of the seat relative to the pedestal.

The Malis Patent discloses a suspension apparatus for an operating room microscope. It comprises an extension arm and swivel joint couplings rotatably connecting the microscope to the extension arm for rotation of the microscope in the vertical plane up to angles of about 140° to about 160°.

The Stone Patent discloses a dispensing receptacle for drafting equipment. It comprises a storage receptacle which is connected to a conventional support that provides a balanced, cantilevered arm.

The Vossoughi Patent discloses an adjustable support for a computer terminal. It comprises a platform for holding the terminal, and proximal and distal arms for vertically and horizontally positioning the platform. The proximal arm comprises top, bottom, proximal and distal members connected to form an articulated parallelogram structure and a rigid sleeve surrounding and slidably engaging the parallelogram structure. A lever arm is pivotally attached to the top and bottom members such that when the lever arm is moved the shape of the parallelogram structure changes, thereby raising or lowering the distal end of the proximal arm.

The Bonnell Patent discloses an arm device for adjustably positioning a medical instrument or the like. It comprises a support joint that supports a movable distal support element relative to a proximal support. The support joint is connected with a mode selector, which upon selection of a first mode of operation by the selector, enables relatively free motion of the support joint for achieving a desired position of the instrument. The mode selector further has a second mode of operation, to set the position of the instrument in space with lightly loaded restraint. The lightly loaded restraint is of a value that, while the second mode continues to be selected, the user may adjust the position of the instrument by application of a light force to the instrument and upon release of such light force by the user, the instrument will remain in the newly adjusted position.

The Warshawsky Patent discloses a less than 360° lamp swivel. It comprises a swivel assembly which has interconnecting members connected together to permit relative rotation of one with respect to the other about an axis of rotation passing through the swivel assembly. It also prevents relative movement of one swivel member with respect to the other along the axis of rotation but which restricts such relative rotation to just under 360°. The interconnections and restriction is provided by swaging operations which displace pieces of material of one swivel member into a groove formed in the other swivel member, and for coaction with a stop formed on the other swivel member.

The Kambara Patent discloses a shaft travel device which has a sliding bracket slidably attached to a support.

The Nakamura Patent discloses a counterbalanced parallel linkage supporting mechanism. It comprises a pair of interlocked parallel links, wherein each link is provided on the opposite side of a center shaft. A weight is supported on one of the parallel links. A counterweight is supported on another parallel link for counterbalancing the weight. A shaft bushing is provided on the center shaft for pivotably supporting the center shaft.

The '812 Swiss Patent, as disclosed from the figures shows a support clamp which is clamped to a plate. The support clamp has a spring retaining means.

The '283 British Patent discloses an adjustable reading-desk and a copy-holder. It is adapted to an arm of any chair, table, and the like which enables the reading desk to swing in any direction required. It comprises a universal joint arrangement operating in conjunction with an adjustable shaft sliding in a socket.

None of these prior art patents have disclosed an adjustable reading stand which can be mounted on a wall or the like for retaining a book, reading material or other articles such that a user can adjust the adjustable reading stand to any position the user desires, where the book is retained thereon and the user's hands are free to perform other functions. It is highly desirable to have a very efficient and also very effective design and construction of an adjustable reading stand which can rotate on a 360° horizontal plane, tilted 90° in a vertical plane and slidably repositioned to a vertical height as desired by the user.

SUMMARY OF THE INVENTION

The present invention is an adjustable reading stand which can be mounted on any wall of a home or business or the like for retaining a book or reading material thereon. The adjustable reading stand retains the reading material so that the user's hands are unoccupied to perform other tasks.

The present invention comprises an elongated mounting base, a vertical sliding rod, a slidable arm base, an elongated horizontal proximal connecting rod, two elongated horizontal spaced apart distal connecting rods, a reading platform pivoting bracket, a reading platform and a spring-biased book spring. The mounting base can be mounted vertically to a wall with the vertical rod facing outwardly away from the wall. The slidable arm base is slidably installed on the vertical rod and is slidable on the rod to adjust a vertical position for the reading platform. A thumb screw knob adjusts and tightens the slidable arm base on the vertical sliding rod.

One end of the proximal connecting rod is hingeably connected between the ends of the two spaced apart distal connecting rods and the other end is attached to the reading platform pivoting bracket. The other ends of the two spaced apart distal connecting rods are integrally connected to the slidable arm base. The reading platform pivoting bracket can rotate on a 360° horizontal plane and tilted 90° in a vertical plane and held in position by an adjustable thumb knob. The present invention further comprises a spring-biased book spring which is attached to the reading platform for retaining the reading material in place. What is unique about the present invention is that it can be adjusted to any position the user desires while the user's hands are free to perform other functions.

It is therefore an object of the present invention to provide an adjustable reading stand which can easily be mounted on a wall or the like for retaining a book or reading material so that a user can maneuver the adjustable reading stand to any position he or she desires while the hands of the user are unoccupied to perform other tasks.

It is also an object of the present invention to provide an adjustable reading stand which comprises a platform capable of independently rotating 360° on a horizontal plane so that a user can easily position the platform to any desired horizontal location.

It is an additional object of the present invention to provide an adjustable reading stand which comprises a platform capable of independently tilting 90° in a vertical plane so that a user can easily position the reading platform to any desired tilting angle.

It is a further object of the present invention to provide an adjustable reading stand which comprises a reading platform capable of being independently repositioned in a vertical height so that a user can easily reposition the reading platform to any desired height.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 5 an enlarged cross-sectional view taken along line 5—5 of FIG. 2;

FIG. 6 is a rear plan view of the swivel head of the present invention hingeably attached to the reading platform pivoting bracket and the reading platform attached the reading platform pivoting bracket; and FIG. 7 is an enlarged cross-sectional view taken along line 7—7 of FIG. 6.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
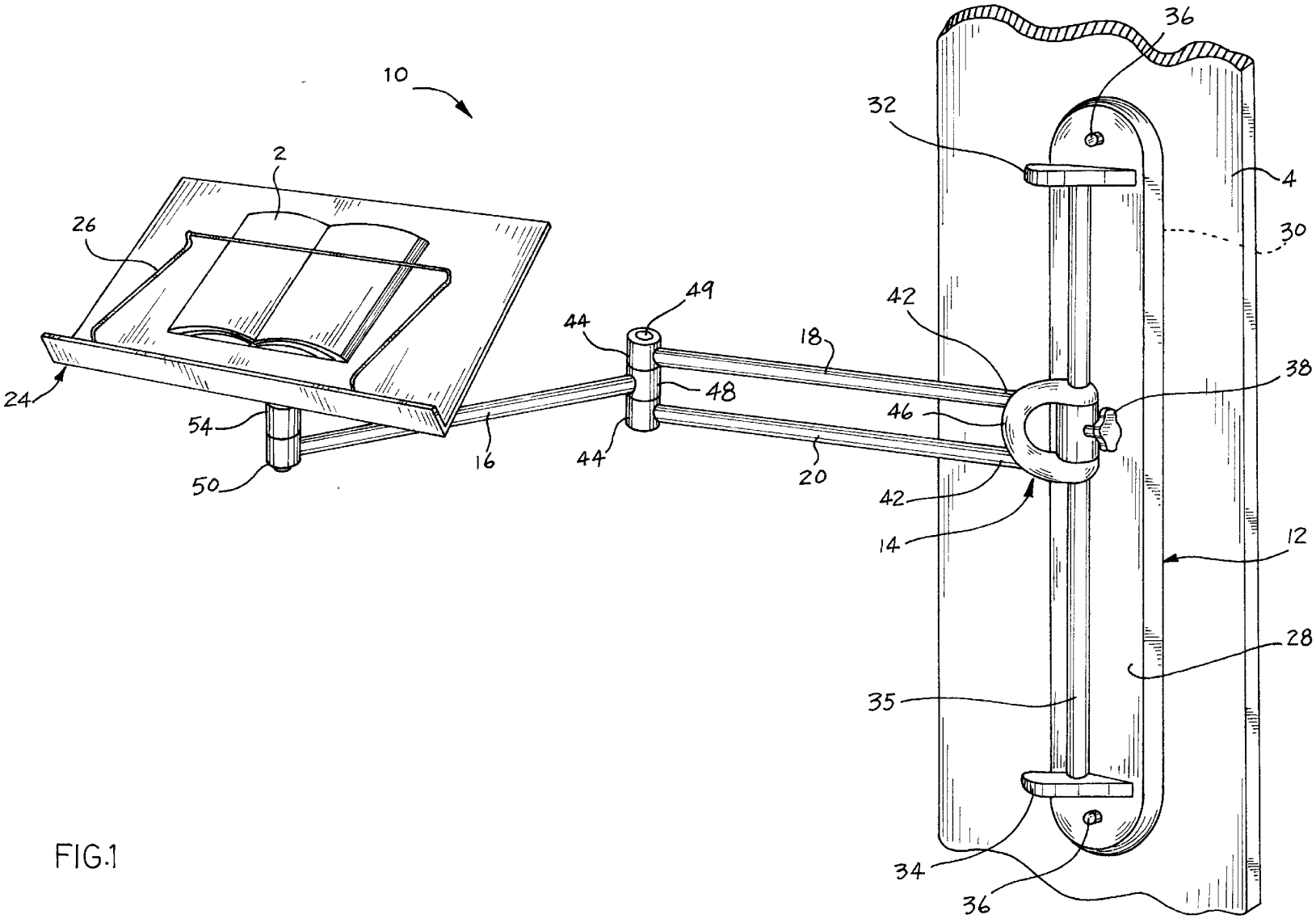
FIG. 1 is a perspective view of the present invention adjustable reading stand, showing the adjustable reading stand mounted to a wall of a home or business.

Referring to FIG. 1, there is shown at 10 a perspective view of the present invention adjustable reading stand which is mounted to a partially shown wall 4. The adjustable reading stand 10 may be mounted to any wall of a home or business for retaining an object such as a book or the like 2 thereon such that a user can maneuver the adjustable reading stand 10 to any position he or she desires. The unique feature of the reading stand 10 is that it retains the object such as a book 2 while the user's hands are unoccupied to perform other tasks.

Figure 2:
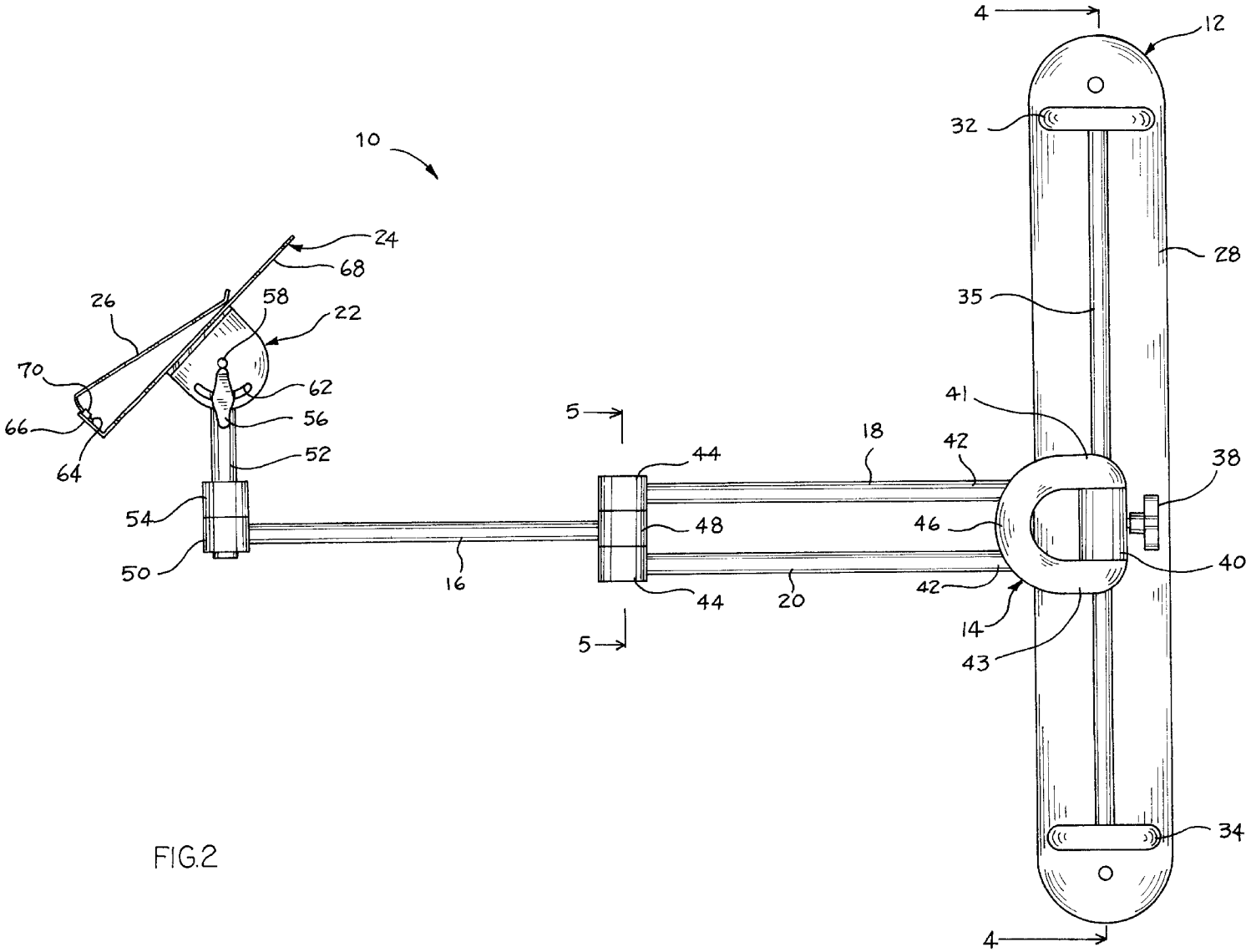
FIG. 2 is a side elevational view of the present invention adjustable reading stand in the extended position.
Figure 3:
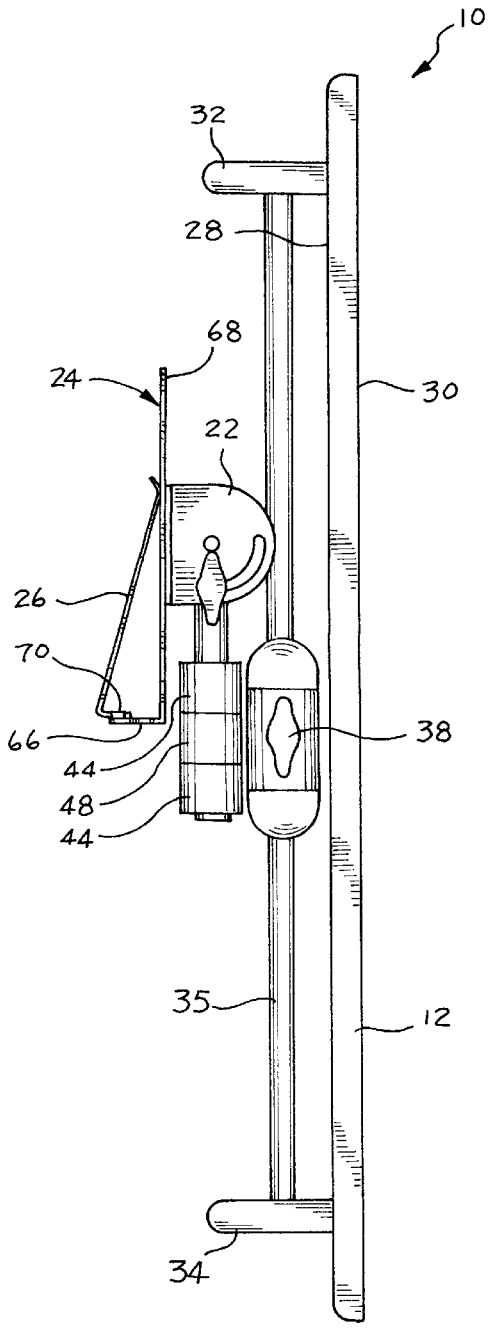
FIG. 3 is a side elevational view of the present invention adjustable reading stand in the closed or unextended position.
Figure 4:
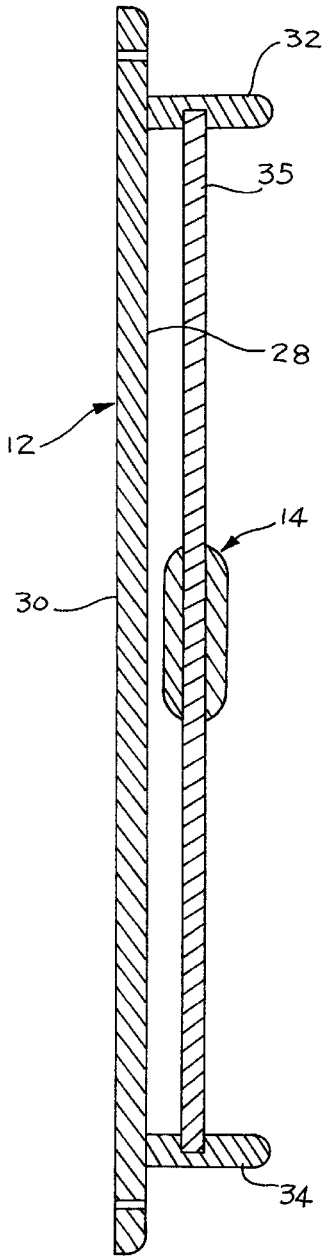
FIG. 4 cross-sectional view taken along line 4—4 of FIG. 2.

FIG. 2 shows a side elevational view of the present invention adjustable reading stand 10 in the extended position. FIG. 3 shows a side elevational view of the present invention adjustable reading stand 10 in the closed or unextended position. FIG. 4 shows a cross-sectional view of the present invention adjustable reading stand 10. Referring to FIGS. 2, 3 and 4, there is shown at 10 the present invention adjustable reading stand which comprises an elongated mounting base or plate 12, a slidable arm base or mounting bracket 14, an elongated horizontal proximal connecting rod or swinging arm 16, two elongated horizontal spaced apart distal connecting rods or swinging arms 18 and 20, a reading platform pivoting bracket 22, a generally rectangular shaped reading platform 24 and a spring-biased book spring 26.

The mounting base 12 comprises a front side 28, a rear side 30, an upper slide rod holder or support 32, a lower slide rod holder or support 34 and an elongated vertical rod 35. The rear side 30 abuts against the wall 4 and is held in position by threaded screw fasteners 36 or other suitable means when the mounting base 12 is being mounted. Both the upper and lower slide rod holders 32 and 34 are generally arch shaped. The flat parts of the upper and lower slide rod holders 32 and 34 are affixed to the front side 28 of the mounting base 12. The arch shaped parts of the upper and lower slide rod holders 32 and 34 are extended away from the front side 28 of the mounting base 12. These slide rod holders 32 and 34 may be attached to the mounting base 12 by threaded screw means (not shown) or other suitable means such as adhesive means. The vertical sliding rod 35 is installed between the upper and lower slide rod holders 32 and 34, and parallel to the mounting base 12.

Referring to FIGS. 1 and 2, there is shown the slidable arm base 14 which is generally U-shaped. The slidable arm base 14 has a cylindrical tube sleeve 40 located between leg portions 41 and 43 of the U-shaped slidable arm base 14. Tips of the leg portions 41 and 43 of the U-shaped base 14 are integrally connected to ends of the tube sleeve 40. The tube sleeve 40 is slidably installed on the vertical sliding rod 35 and can be independently adjusted to a vertical height as desired by a user and held or released in that vertical height by tightening or loosening a thumb screw knob 38.

Each of the two horizontal spaced apart distal connecting rods 18 and 20 comprises a distal end 42 and a proximal hinge end 44. The distal ends 42 of the connecting rods 18 and 20 are integrally connected to tip 46 of the slidable arm base 14, where the two leg portions 41 and 43 are jointed together to form the U-portion 46.

Referring to FIGS. 2 and 5, there is shown at 16 the horizontal proximal connecting rod which comprises a distal hinge end 48 and a proximal hinge end 50. The distal hinge end 48 of the proximal connecting rod 16 is hingeably and rotatably connected between the proximal hinge ends 44 of the two horizontal distal connecting rods 18 and 20, and secured by a hinge pin 49 (see FIG. 5), thereby allowing the proximal connecting rod 16 to swing and extend in a horizontal plane (see FIG. 2).

FIG. 6 shows a rear plan view of the reading platform 24 of the present invention. Referring to FIGS. 2 and 6, there is shown at 22 the pivoting bracket which is attached to a back side of the reading platform 24 by screw means or other suitable means. A head mounting rod assembly or hinge assembly 51 comprises an elongated rod 52 and a lower head hinge end 54 which is integrally formed with the elongated rod 52. The bottom portion of the elongated rod 52 is hingeably and rotatably connected to the proximal hinge end 50 of the proximal connecting rod 16 such that the lower head hinge end 54 abuts against the top of the proximal hinge end 50 of the proximal connecting rod 16. The elongated rod 52 extends upwardly to be attached at the upper portion by the pivoting bracket 22. The head mounting rod assembly 51 can be independently rotated in a 360° horizontal plane.

The pivoting bracket 22 is hingeably attached to the top portion of the elongated rod 52 and secured by a hinge pin 58 and a snap ring 60. The pivoting bracket 22 has a curved slotted opening 62, where an adjustable thumb knob 56 is threadedly engaged within the curved slotted opening 62 and secured thereon and tighten to hold the position of the reading platform 24 as desired. The pivoting bracket 22 can be independently tilted in a vertical plane, e.g., approximately in a range of 0°–90° and held or released in that position by tightening or loosening the adjustable thumb knob 56 so that the reading platform 24 will be held at a specific position as desired by the user. The tilting adjustment is done by loosing the adjustable thumb knob 56 so that the reading platform 24 can be independently adjusted at a tilted angle as desired by the user. The reading platform 24 can be independently rotated in a 360° rotation as desired by the user. Furthermore, the reading platform 24 can be independently repositioned to a vertical height by loosening the thumb screw knob 38 and sliding the slidable arm base 14 to a specific height as desired by the user.

Referring to FIGS. 1, 2 and 3, there is show at 24 an L-shaped structure of the reading platform 24 (see FIG. 3). The reading platform 24 comprises a horizontal portion 66 and a vertical portion 68. The vertical portion 68 is integrally formed with and upwardly extends from the horizontal portion 66 of the reading platform 24. A spring-biased book spring 26 is formed by an elongated continuous rod, where both ends form an identical hook or retaining means 64. The hook ends 64 are respectively inserted into two apertures 70 which is provided on the horizontal leg portion 66 of the reading platform 24.

The operation of the foregoing embodiment now will be described. The adjustable reading stand 10 is used for retaining the book 2 or the like thereon such that the reading platform 24 can be independently adjusted in the horizontal and vertical planes to any position a user desires. Referring to FIG. 3, there is shown at 10 the adjustable reading stand in its closed or unextended position or inoperative position. Also, the reading platform 24 can be tilted in a range of approximately 0° to 90° angle as desired by the user, where the reading platform 24 completely retains the book or the like, and thereby the user's hands are unoccupied to perform other functions. Referring to FIG. 2, there is shown at 10 the adjustable reading stand in its extended position or operative position, where the proximal and distal connecting rods are fully extended. The reading platform 24 is positioned at an approximately 45° angle.

The adjustable reading stand 10 may be made from several materials. By way of example, the adjustable reading stand 10 can be made of metal material or any other suitable material, e.g., such as wood or plastic. The present invention conforms to conventional forms of manufacture, and may be constructed in any conventional way known to one skilled in the art.

It will be appreciated that the present invention is not limited to the two distal swinging arms 18 and 20. It is emphasized that while the two distal swinging arms are the preferred to given the reading stand stability, it is also within the spirit and scope of the present invention to utilize only one distal swinging arm or just one swinging arm.

Defined in detail, the present invention is an adjustable stand mountable to a wall or the like for retaining an object, comprising: (a) an elongated mounting base having a rear side and a front side, the rear side mounted to the wall; (b) a lower slide rod holder affixed to and extending away from the front side of the mounting base; (c) an upper slide rod holder affixed to and extending away from the front side of the mounting base and opposite from the lower slide rod holder; (d) a vertical sliding rod installed between the upper and lower slide rod holders and parallel to the mounting base: (e) a generally U-shaped slidable arm base having a tube sleeve slidably installed on the vertical sliding rod such that the slidable arm base can be independently adjusted to a vertical height and held or released by tightening or loosening a thumb screw knob; (f) two elongated horizontal spaced apart distal connecting rods, each having a distal end and a proximal hinge end, the distal ends integrally attached to the slidable arm base; (g) an elongated horizontal proximal connecting rod having a distal hinge end and a proximal hinge end, the distal hinge end hingeably and rotatably connected between the proximal hinge ends of the two horizontal spaced apart distal connecting rods and secured therebetween by a hinge pin; (h) a mounting head rod assembly having an elongated rod and a lower head hinge end integrally formed with the elongated rod, the elongated rod having a bottom portion and an upper portion, the bottom portion hingeably and rotatably connected to the proximal hinge end of the proximal connecting rod such that the lower head hinge end abuts against the proximal hinge end of the proximal connecting rod, where the mounting head rod assembly can be independently rotated 360° in a horizontal plane; (i) a pivoting bracket having a curved slotted opening and hingeably attached to the top portion of the elongated rod of the mounting head rod assembly and secured by a hinge pin such that the pivoting bracket can be independently tilted in a vertical plane and held or released by tightening or loosening an adjustable thumb knob; and (j) a generally rectangular shaped platform hingeably connected to the pivoting bracket; (k) whereby the adjustable stand can be independently adjusted in the horizontal plane, the vertical plane, and the vertical height to any position a user desires, where the platform completely retains the object, and thereby the user's hands are unoccupied to perform other functions.

Defined broadly, the present invention is a stand mountable to a wall or the like for retaining an object, comprising: (a) a mounting base having a rear side and a front side, the rear side mounted to the wall; (b) two opposite slide rod holders affixed to and extending away from the front side of the mounting base; (c) a rod installed between the two opposite slide rod holders; (d) a slidable arm base slidably attached to the rod such that the slidable arm base can be slidably adjusted to a vertical height; (e) at least one distal swing arm having a distal end and a proximal end, the distal end attached to the slidable arm base; (f) a proximal swing arm having a distal end and a proximal end, the distal end hingeably and rotatably connected to the proximal end of the at least one distal swing arm; (g) a hinge assembly hingeably and rotatably connected to the proximal end of the proximal swing arm, where the hinge assembly can be independently rotated in a horizontal plane; (h) a pivoting bracket hingeably connected to the hinge assembly such that the pivoting bracket can be independently tilted in a vertical plane; and (i) a platform hingeably connected to the pivoting bracket; (j) whereby the stand can be independently adjusted in the horizontal plane, the vertical plane, and the vertical height to any position a user desires, where the platform completely retains the object, and thereby the user's hands are unoccupied to perform other functions.

Defined more broadly, the present invention is a stand mountable to a wall or the like for retaining an object, comprising: (a) a mounting base mounted to the wall; (b) a rod supported by and positioned in parallel to the mounting base; (c) at least one swinging arm having a distal end and a proximal end, the distal end slidably attached to the rod such that the at least one swinging arm can move to a vertical height; (d) a hinge assembly connected to the proximal end of the at least one swinging arm, such that the hinge assembly can rotate in a horizontal plane; (e) a pivoting bracket attached to the hinge assembly such that the pivoting bracket can tilt in a vertical plane; and (f) a platform attached to the pivoting bracket; (g) whereby the stand can be rotated in the horizontal plane, tilted in the vertical plane, and adjusted in the vertical height to any position a user desires, where the platform completely retains the object, and thereby the user's hands are unoccupied to perform other functions.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An adjustable stand mountable to a wall for retaining an object, comprising:

a. an elongated mounting base having a rear side and a front side, the rear side mounted to said wall;

b. a lower slide rod holder affixed to and extending away from said front side of said mounting base;

c. an upper slide rod holder affixed to and extending away from said front side of said mounting base and opposite from said lower slide rod holder;

d. a vertical sliding rod installed between said upper and lower slide rod holders and parallel to said mounting base;

e. a generally U-shaped slidable arm base having a tube sleeve slidably installed on said vertical sliding rod such that the slidable arm base can be independently adjusted to a vertical height and held or released by tightening or loosening a thumb screw knob;

f. two elongated horizontal spaced apart distal connecting rods, each having a distal end and a proximal hinge end, the distal ends integrally attached to said slidable arm base;

g. an elongated horizontal proximal connecting rod having a distal hinge end and a proximal hinge end, the distal hinge end hingeably and rotatably connected between said proximal hinge ends of said two horizontal spaced apart distal connecting rods and secured therebetween by a hinge pin, where the distal hinge end of the proximal connecting rod can be independently rotated in a horizontal plane between said proximal hinge ends of said distal connecting rods;

h. a mounting head rod assembly having an elongated rod and a lower head hinge end integrally formed with the elongated rod, the elongated rod having a bottom portion and an upper portion, the bottom portion hingeably and rotatably connected to said proximal hinge end of said proximal connecting rod such that the lower head hinge end abuts against said proximal hinge end of said proximal connecting rod, where the mounting head rod assembly can be independently rotated 360° in a horizontal plane;

i. a pivoting bracket having a curved slotted opening and hingeably attached to said top portion of said elongated rod of said mounting head rod assembly and secured by a hinge pin such that the pivoting bracket can be independently tilted in a vertical plane in a range of approximately 0°–90° and held or released by tightening or loosening an adjustable thumb knob; and j. a generally rectangular shaped platform hingeably connected to said pivoting bracket;

k. whereby said adjustable stand can be independently adjusted in the horizontal plane, the vertical plane, and the vertical height to any position a user desires, where said platform completely retains the object, and thereby the user's hands are unoccupied to perform other functions.

2. The adjustable stand in accordance with claim 1 further comprising a spring-biased book spring connected to said platform for retaining the object in place.

3. The adjustable stand in accordance with claim 1 wherein said stand is made of metal.

4. A stand mountable to a wall for retaining an object, comprising:

a. a mounting base having a rear side and a front side, the rear side mounted to said wall;

b. two opposite slide rod holders affixed to and extending away from said front side of said mounting base;

c. a rod installed between said two opposite slide rod holders;

d. a slidable arm base slidably attached to said rod such that the slidable arm base can be slidably adjusted to a vertical height;

e. at least one distal swing arm having a distal end and a proximal end, the distal end attached to said slidable arm base;

f. a proximal swing arm having a distal end and a proximal end, the distal end hingeably and rotatably connected to said proximal end of said at least one distal swing arm, where the distal end of the proximal swing arm can be independently rotated in a horizontal plane;

g. a hinge assembly hingeably and rotatably connected to said proximal end of said proximal swing arm, where the hinge assembly can be independently rotated 360° in a horizontal plane;

h. a pivoting bracket hingeably connected to said hinge assembly such that the pivoting bracket can be independently tilted in a vertical plane in a range of approximately 0° to 90°; and i. a platform hingeably connected to said pivoting bracket;

j. whereby said stand can be independently adjusted in the horizontal plane, the vertical plane, and the vertical height to any position a user desires, where said platform completely retains the object, and thereby the user's hands are unoccupied to perform other functions.

5. The stand in accordance with claim 4 further comprising a spring-biased book spring connected to said platform for retaining the object in place.

6. The stand in accordance with claim 4 wherein said stand is made of metal.

7. The stand in accordance with claim 4 wherein said distal end of said proximal swing arm is connected to said proximal end of said at least one distal swing arm by a hinge pin.

8. The stand in accordance with claim 4 wherein said slidable arm base is generally a U-shape.

9. The stand in accordance with claim 4 wherein said slidable arm base includes a thumb screw knob for tightening or loosening the vertical height of said platform.

10. The stand in accordance with claim 4 wherein said pivoting bracket includes another thumb screw knob for tightening or loosening the tilted angle of said platform.

11. A stand mountable to a wall for retaining an object, comprising:

a. a mounting base mounted to said wall;

b. a rod supported by and positioned in parallel to said mounting base;

c. at least one swinging arm having a distal end and a proximal end, the distal end slidably attached to said rod such that the at least one swinging arm can move to a vertical height.

d. A hinge assembly connected to said proximal end of said at least one swinging arm, such that the hinge assembly can rotate 360° in a horizontal plane;

e. a pivoting bracket attached to said hinge assembly such that the pivoting bracket can tilt in a vertical plane in a range of approximately 0°–90°; and f. a platform attached to said pivoting bracket;

g. whereby said stand can be rotated in the horizontal plane, tilted in the vertical plane, and adjusted in the vertical height to any position a user desires, where said platform completely retains the object, and thereby the user's hands are unoccupied to perform other functions.

12. The stand in accordance with claim 11 further comprising a spring-biased book spring connected to said platform for retaining the object in place.

13. The stand in accordance with claim 11 further comprising an adjustable thumb knob for tightening or loosening said pivoting bracket to hold or release the tilted vertical plane of said platform.

14. The stand in accordance with claim 11 wherein said stand is made of metal.

15. The stand in accordance with claim 11 wherein said rod is supported by two opposite support holders affixed to and extending away from said mounting base.

* * * * *